United States Patent [19]

Nishio et al.

[11] 4,442,375

[45] Apr. 10, 1984

[54] ELECTRICAL SELF-PURIFICATION IGNITION PLUG

[75] Inventors: Kanemitsu Nishio, Komaki; Shunichi Takagi, Tajimi; Yasuhiko Suzuki, Nagoya, all of Japan

[73] Assignee: NGK Spark Plug Co., Ltd., Nagoya, Japan

[21] Appl. No.: 176,800

[22] Filed: Aug. 11, 1980

[30] Foreign Application Priority Data

Sep. 14, 1979 [JP] Japan ..... 54-117208
Sep. 14, 1979 [JP] Japan ..... 54-117209

[51] Int. Cl.[3] ..... H01T 13/20
[52] U.S. Cl. ..... 313/142; 313/143
[58] Field of Search ..... 313/141, 131 R, 143, 313/145, 142

[56] References Cited

U.S. PATENT DOCUMENTS

| | | | |
|---|---|---|---|
| 1,181,425 | 5/1916 | Blattmann | 313/142 |
| 2,208,178 | 7/1940 | Berstler | 313/143 |
| 2,296,045 | 9/1942 | McDougal et al. | 313/142 X |
| 2,604,087 | 7/1952 | Gregory et al. | 313/141 X |
| 3,133,223 | 5/1964 | Mallory | 313/141 X |
| 3,442,693 | 5/1969 | Rea | 313/131 R X |
| 3,691,419 | 9/1972 | Van Uum et al. | 313/141 X |
| 4,110,667 | 8/1978 | Hagen | 313/143 |

FOREIGN PATENT DOCUMENTS

| | | | |
|---|---|---|---|
| 591740 | 1/1934 | Fed. Rep. of Germany | 313/131 |
| 50-152130 | 12/1975 | Japan . | |

*Primary Examiner*—Palmer C. Demeo
*Attorney, Agent, or Firm*—Parkhurst & Oliff

[57] ABSTRACT

An electrical self-purification ignition plug comprising a porcelain insulator ignition leg provided at its end surface opposed to a grounded electrode with a conical depression, and a center electrode exposed to the base surface of said conical depression and made integral with said porcelain insulator.

6 Claims, 13 Drawing Figures

FIG. 1
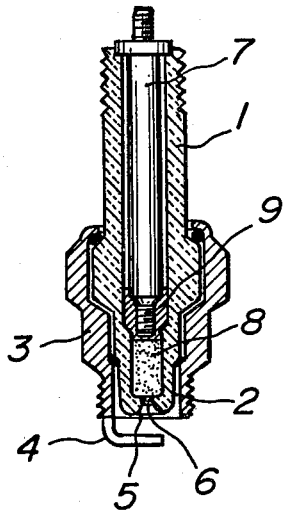
FIG. 2
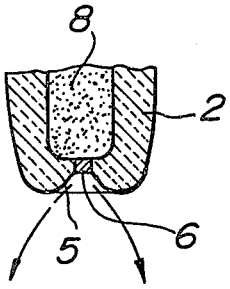
FIG. 3a
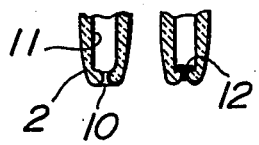
FIG. 3b
FIG. 3c
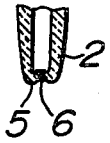
FIG. 3d
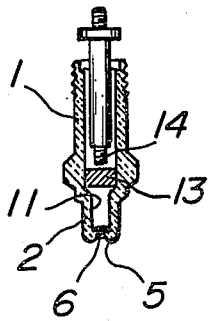
FIG. 3e
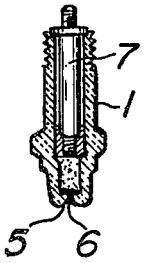

FIG. 4
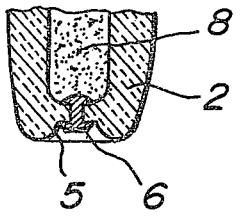
FIG. 5a
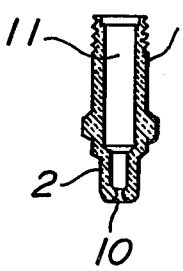
FIG. 5b
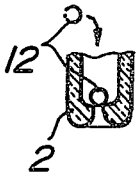
Hot Press FIG. 5c
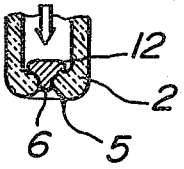
FIG. 5d
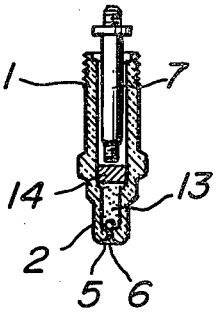
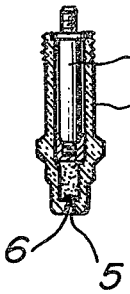
FIG. 5e

ELECTRICAL SELF-PURIFICATION IGNITION PLUG

BACKGROUND OF THE INVENTION

1. Field of the Invention

This invention relates to an electrical self-purification ignition plug.

2. Description of the Prior Art

Concerning the prevention of fouling of an ignition plug, a technique of burning off or blowing away carbon or the like deposited on a porcelain insulator ignition leg and composed of a combustion residue adhered thereto with an electrical energy of a spark discharge has heretofore been well known as an electrical self-purification action.

In order to cause an ignition plug provided with an air gap between a grounded electrode and a center electrode to display the above mentioned self-purification action, an attempt has been made to locate the front end of the center electrode at a position which is recessed into the end surface of the porcelain insulator ignition leg and make the outer diameter of the front end of the center electrode smaller than the inner diameter of the ignition leg. In this case, if the diameter of the front end of the center electrode is too small, the life of the ignition plug becomes short. As a result, it is desirous to make the inner diameter of the ignition leg large. But the outer diameter of the ignition leg is restricted by the presence of an annular gap between the ignition leg and the inner surface of the metal fitting of the ignition plug proper, that is, the presence of a so-called gas volume. As a result, the ignition leg must be thin in thickness and hence the ignition leg having a thin thickness is exposed to the high temperature combustion gas and tends to produce a hot spot thereon, thereby inducing a preignition failure.

SUMMARY OF THE INVENTION

An object of the invention, therefore, is to provide an electrical self-purification ignition plug which can eliminate the above mentioned drawbacks which have been encountered with the prior art techniques, which is provided with an improved center electrode and which has excellent electrical self-purification ability against carbon or the like deposited on the outer surface of the porcelain insulator ignition leg.

A feature of the invention is the provision of an electrical self-purification ignition plug comprising a porcelain insulator ignition plug provided at its end surface opposed to a grounded electrode with a conical depression, and a center electrode exposed to the base surface of said conical depression and made integral with the porcelain insulator.

Further objects and features of the invention will be fully understood from the following detailed description with reference to the accompanying drawings, wherein:

BRIEF DESCRIPTION OF THE DRAWINGS

FIG. 1 is a cross-sectional view of an embodiment of an electrical self-purification ignition plug according to the invention;

FIG. 2 is an enlarged cross-sectional view of essential parts of the ignition plug shown in FIG. 1;

FIG. 3*a* to 3*e* are cross-sectional views illustrating successive steps of manufacturing the ignition plug shown in FIG. 1;

FIG. 4 is an enlarged cross-sectional view of essential parts of another embodiment of an ignition plug according to the invention; and FIGS. 5*a* to 5*e* are cross-sectional views illustrating successive steps of manufacturing the ignition plug shown in FIG. 4.

DETAILED DESCRIPTION OF THE PREFERRED EMBODIMENTS

FIG. 1 shows an embodiment of an electrical self-purification ignition plug according to the invention. In FIG. 1, reference numeral 1 designates a porcelain insulator; 2 its ignition leg; 3 a main body metal fitting; 4 a grounded electrode; 5 a conical depression formed in the end surface of the ignition leg 2 and opposed to the grounded electrode 4; 6 a center electrode exposed to the base surface of the conical depression 5; 7 a center shaft made integral with a terminal electrode for the sake of simpleness; 8 a sealed resistor; and 9 an electrically conductive glass seal.

FIG. 2 shows essential parts of the ignition plug shown in FIG. 1, a creeping discharge passage being shown by an arrow. Even though the surface of the conical depression 5 is subjected to fouling due to carbon or the like deposited thereon when the ignition plug is used under well known conditions, the creeping discharge spark is slidably guided along the surface of the conical depression 5 in a specially easy manner. This sliding movement of the spark tends to induce a reliable electrical self purification action. As a result, an elongate spark discharge occurs in the air gap formed between the center electrode 6 thus purified and the grounded electrode 4, thereby improving the ignition property.

The profile of the conical depression 5 may be of concave conical surface or of more or less curved surface as shown in FIG. 2.

FIGS. 3*a* to 3*e* show one example of successive steps of manufacturing the ignition plug shown in FIG. 1. A leg end hole 10 of the ignition leg 2 shown in FIG. 3*a* is filled with a filling material 12 essentially consisting of mixed powders of an electrode material such as Pt, Pd, $Al_2O_3$ and Fe-Ni-Cr alloy as shown in FIG. 3*b*. Then, the filling material 12 is heated at a temperature on the order of 1,600° C. in atmospheric air by the conventional method of firing the porcelain insulator to obtain the porcelain insulator 1 having the center electrode 6 made integral therewith by firing and exposed at the base surface of the conical depression 5 provided at the ignition leg end as shown in FIG. 3*c*. The porcelain insulator 1 thus obtained is glazed by the conventional method. Then, into a hollow cavity 11 are inserted a given amount of compounding material 13 formed of resistor compositions and a given amount of compounding material 14 formed of electrically conductive glass seal compositions in the order as mentioned above, and then a center shaft 7 is inserted and subsequently heated under pressure to effect a complete joint as shown in FIG. 3*e*.

An example of the compositions of the filling material 12 used in the case of providing the center electrode 6 by firing it together with the ignition leg 2 was mentioned above. A preferred amount of these compositions is as follows. But, use may be made of any other compositions and amount thereof which can play the role of the center electrode.

| Example of Compositions | |
|---|---|
| Pt powder | 40 to 60 wt % |
| Pd powder | 20 to 30 wt % |
| $Al_2O_3$ powder (which is the same in composition as alumina porcelain insulator consisting of 90% $Al_2O_3$-10% $SiO_2$, MgO, CaO) | 10 to 30 wt % |
| Fe—Ni—Cr alloy powder | 1 to 3 wt % |

To the above mentioned compounding agent is added a small amount of varnish and a mixture thus obtained is kneaded and shaped into spherical particles each having a diameter of 1.0 mmϕ.

In the present embodiment, the ignition leg end of the porcelain insulator is made electrically conductive during firing of the porcelain insulator so as to form the center electrode at the same time. As a result, the ignition leg portion can freely be constructed without restraint and hence the ignition plug according to the invention is long in life and has an excellent ability as requested.

FIG. 4 shows another embodiment of an electrical self-purification ignition plug according to the invention. In the present embodiment, the center electrode exposed to the base surface of the conical depression and opposed to the grounded electrode is composed of a metal chip 6 sealed with the porcelain insulator ignition leg 2 at a high temperature.

FIGS. 5*a* to 5*e* show an example of successive steps of manufacturing the ignition plug shown in FIG. 4. In the present embodiment, in the first place, the porcelain insulator 1 is provided at the end surface of the ignition leg 2 thereof with a conical depression 5 and an end hole 10 open at the base surface of the conical depression 5 as shown in FIG. 5*a*. The end hole 10 is formed by reducing the diameter of the hollow cavity 11 of the porcelain insulator 1 and then the porcelain insulator 1 is fired by the conventional method. A spherical mass 12 formed of a Ni base alloy is inserted from the hollow cavity 11 into the end hole 10, then the spherical mass 12 is heated under pressure by means of a hot press including a lower mold suitably engaged with the end surface configuration of the ignition leg end 2 and an upper mold for adequately pressing the spherical mass 12 (the lower and upper molds being not shown) so as to cause the spherical mass 12 to produce mold deformation and seal it with the ignition leg end 2 at a high temperature. In this way, the center electrode 6 composed of the metal chip is exposed to the base surface of the conical depression 5.

The degree of exposure of the metal chip is determined such that the life of the ignition plug dependent on the consumption of the center electrode is sufficiently long.

Then, as shown in FIG. 5*d*, into the hollow cavity 11 are inserted a given amount of a compounding material 13 composed of resistor compositions and a given amount of a compounding material 14 composed of electrically conductive glass seal compositions in the order mentioned above. Then, a center shaft 7 is inserted into the hollow cavity 11, thereby effecting a complete joint of the center shaft 7 with the compounding material 14 and porcelain insulator 1 as shown in FIG. 3*e*.

In the present embodiment, the porcelain insulator is provided at the ignition leg end thereof with the conical depression and the ignition leg hollow cavity is reduced in diameter to provide the end hole. Into the end hole is sealed the spherical metal chip formed of metal selected from the group consisting of Ni, Ni base alloy and Au-Pd alloy and heated under pressure by means of the hot press so as to soften the metal chip. As a result, the metal chip is subjected to mold deformation and is exposed to the base surface of the conical depression and closely adhered to the inner surface of the ignition leg. Then, the resistor, electrically conductive glass seal and center shaft are inserted into the porcelain insulator and sealed and joined together. As a result, similar to the previous embodiment, the ignition leg portion can freely be constructed without restraint and hence the ignition plug according to the invention is long in life and has an excellent ability as requested.

As stated hereinbefore, in the present invention, the center electrode is exposed to the base surface of the conical depression provided at the ignition leg end of the porcelain insulator and made integral therewith. As a result, the ignition plug according to the invention is capable of enlarging the diameter of the exposed end of the center electrode to a value which can meet the needs of making the life of the ignition plug long without making the thickness of the ignition leg thin and of efficiently and reliably displaying the electrical self-purification action under a condition of maintaining sufficiently large gas volume about the ignition leg without producing any hot spot and hence without inducing any preignition due to such hot spot.

What is claimed is:

1. An electrical self-purification ignition plug comprising a porcelain insulator ignition leg provided with a conical depression at its end surface opposed to a grounded electrode, and a center electrode exposed to the base surface of said conical depression and made integral with said porcelain insulator, said center electrode being formed of a filling material consisting of an electrode material consisting essentially of mixed powder of Pt, Pd, $Al_2O_3$ and Fe-Ni-Cr alloy and made integral with said porcelain insulator by firing at a temperature on the order of 1,600° C. in an air atmosphere.

2. An electrical self-purification ignition plug comprising a porcelain insulator ignition leg provided with a conical depression at its end surface opposed to a grounded electrode, and a center electrode exposed to the base surface of said conical depression and made integral with said porcelain insulator, said center electrode being composed of a metal chip formed of a metal selected from the group consisting of Ni, Ni base alloy and Au-Pd alloy and made integral with said porcelain insulator by hot pressing at a softening temperature of said metal chip.

3. An electrical self-purification ignition plug of wide heat range type, comprising a porcelain insulator ignition leg, a center electrode, a main body metal fitting and a grounded electrode, said porcelain insulator ignition leg being provided with a conical depression at an end surface thereof which is opposed to said grounded electrode, said porcelain insulator ignition leg being spaced from an inner surface of said main body metal fitting by an annular space sufficiently large to permit free flow of combustion gas therethrough, and said center electrode being exposed to a base surface of said conical depression without protruding from said conical depression and made integral with said porcelain insulator at least in the area of said conical depression to prevent hot spots and thereby avoid preignition.

4. The ignition plug according to claim 3, wherein said center electrode is formed of a filling material consisting of an electrode material and made directly integral with said porcelain insulator by firing.

5. The ignition plug according to claim 3, wherein said center electrode is composed of a metal chip and is made integral with said porcelain insulator by high temperature sealing of said metal chip directly to said porcelain insulator.

6. The ignition plug according to claim 3, wherein the center electrode is made integral with the porcelain insulator by hot pressing the center electrode from the interior of the porcelain body against a lower mold engaged with the exterior of said end surface of the ignition leg.

* * * * *